US008753130B2

(12) United States Patent
Sato et al.

(10) Patent No.: US 8,753,130 B2
(45) Date of Patent: Jun. 17, 2014

(54) INTERPOSER AND JOINT TERMINAL

(75) Inventors: Koki Sato, Shinagawa (JP); Mitsuru Kobayashi, Shinagawa (JP); Hideo Miyazawa, Shinagawa (JP); Koutarou Yamasita, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 3 days.

(21) Appl. No.: 13/413,255

(22) Filed: Mar. 6, 2012

(65) Prior Publication Data

US 2012/0231667 A1 Sep. 13, 2012

(30) Foreign Application Priority Data

Mar. 8, 2011 (JP) ..... 2011-050096

(51) Int. Cl.
*H01R 12/00* (2006.01)

(52) U.S. Cl.
USPC ..... 439/66; 439/700

(58) Field of Classification Search
USPC ..... 439/66, 700
See application file for complete search history.

(56) References Cited

U.S. PATENT DOCUMENTS

| | | | | |
|---|---|---|---|---|
| 4,029,375 | A * | 6/1977 | Gabrielian | 439/66 |
| 5,807,123 | A * | 9/1998 | Spiegelaar et al. | 439/188 |
| 6,264,476 | B1 * | 7/2001 | Li et al. | 439/66 |
| 6,626,708 | B2 * | 9/2003 | Phillips | 439/700 |
| 6,796,850 | B2 * | 9/2004 | Matsui et al. | 439/700 |
| 6,855,010 | B1 * | 2/2005 | Yen | 439/700 |
| 7,040,902 | B2 * | 5/2006 | Li | 439/66 |
| 7,297,004 | B1 * | 11/2007 | Shuhart et al. | 439/66 |
| 7,335,068 | B2 * | 2/2008 | Dwan et al. | 439/700 |
| 7,942,677 | B2 * | 5/2011 | Rikimaru et al. | 439/66 |
| 2006/0172613 | A1 * | 8/2006 | Sasaki | 439/824 |
| 2009/0221189 | A1 * | 9/2009 | Xu | 439/700 |
| 2012/0208406 | A1 * | 8/2012 | Lin | 439/700 |
| 2012/0231667 | A1 * | 9/2012 | Sato et al. | 439/626 |

FOREIGN PATENT DOCUMENTS

| | | |
|---|---|---|
| JP | 2003-124404 | 4/2003 |
| JP | 2009-2865 | 1/2009 |

* cited by examiner

*Primary Examiner* — James Harvey
(74) *Attorney, Agent, or Firm* — Staas & Halsey LLP

(57) ABSTRACT

A joint terminal usable in an interposer. The joint terminal includes a first terminal member; and a second terminal member detachably attached to the first terminal member and electrically conductible to the first terminal member. The second terminal member includes a contact part capable of contacting with and separating from a conductor portion of a counterpart of the interposer; a spring part adapted to generate a contact pressure for pushing the contact part against the conductor portion; and an attachment part abutting on and detachably attached by a frictional force to the first terminal member. The contact part, the spring part and the attachment part are formed integrally with each other as a unitary member.

11 Claims, 7 Drawing Sheets

INTERPOSER AND JOINT TERMINAL

CROSS-REFERENCE TO RELATED APPLICATIONS

This application is based upon and claims the benefit of priority from prior Japanese Patent Application No. 2011-050096 filed on Mar. 8, 2011, the entire contents of which are incorporated herein by reference.

BACKGROUND OF THE INVENTION

1. Field of the Invention

The present invention relates to an interposer. The present invention also relates to a joint terminal usable in an interposer.

2. Description of the Related Art

An interposer has been known as a relaying component adapted to be interposed between two electronic circuit components, such as a circuit board (a printed wiring board (PWB), a printed circuit board (PCB), etc.) and an IC package, and to fulfill a function such as converting the arrangement or number of connection terminals of the electronic circuit components, absorbing the difference in thermal deformation of the electronic circuit components, etc. Conventionally, the interposer includes a substrate (e.g., a circuit board or a board with no circuitry) and a desired number of joint terminals fixed to the substrate.

Japanese Unexamined Patent Publication (Kokai) No. 2003-124404 (JP2003-124404A) describes an electrical contact capable of being used in an interposer. The electrical contact described in JP2003-124404A is formed to be fixed on the surface of a printed circuit board by "metal forming, masking, etching, and soldering technique", which configures an interposer. JP2003-124404A also describes that the interposer is "used for detachably attaching an electronic device, such as a multichip module (MCM), on the circuit board".

Japanese Unexamined Patent Publication (Kokai) No. 2009-2865 (JP2009-2865A) describes a probe card provided in an IC device tester, which includes a first board provided with a probe element, a second circuit board provided with a wiring pattern, and an interposer interposed between the boards and electrically connecting the boards to each other. The interposer includes a plurality of elastic, electrically-conductive connecting elements and a carrier board carrying the connecting elements. The connecting elements are respectively connected at opposite ends thereof to pads formed on the first and second boards.

In a conventional interposer in which a plurality of joint terminals are fixed to a substrate, it is difficult to detach a desired one of joint terminals from the substrate or attach a new joint terminal to the substrate. Thus, when any one of the joint terminals is deformed or damaged, it is difficult to replace only such a damaged joint terminal with a new one, and as a result, it is necessary to replace the interposer as a whole even though it includes an undeformed or undamaged joint terminal.

SUMMARY OF THE INVENTION

It is desired to allow any one of joint terminals provided in an interposer to be replaced as needed.

One aspect of the invention provides a joint terminal usable in an interposer, comprising a first terminal member; and a second terminal member detachably attached to the first terminal member and electrically conductible to the first terminal member, the second terminal member including a contact part capable of contacting with and separating from a conductor portion of a counterpart of the interposer; a spring part adapted to generate a contact pressure for pushing the contact part against the conductor portion; and an attachment part abutting on and detachably attached by a frictional force to the first terminal member; the contact part, the spring part and the attachment part being formed integrally with each other as a unitary member.

The joint terminal configured as described above has a two-piece structure wherein the first terminal member and the second terminal member are able to be attached to and detached from each other. Therefore, when the joint terminal is deformed or damaged in, especially, the contact part or the spring part, it is possible to replace only the second terminal member with a new one while the first terminal member remains to be fixed to the substrate. As a result, in the interposer including a plurality of joint terminals fixed to the substrate, a repairing work of the joint terminals can be facilitated, and a working cost can be reduced by replacing only the damaged second terminal member with a new one. Further, it is possible to select a second terminal member having a desired spring constant, from among several different types of previously prepared second terminal members having various spring constants, and attach the selected second terminal member to the first terminal member for use. Therefore, it is possible to easily manufacture, on demand, the interposer including the joint terminal capable of generating a required contact pressure to a counterpart conductor portion, by attaching the second terminal member selected from the several types of second terminal members to the first terminal member fixed to the substrate.

The other aspect of the invention provides an interposer comprising a joint terminal as set forth above; and a substrate to which the first terminal member of the joint terminal is fixed.

According to the above interposer, it is possible to facilitate a work for repairing the joint terminals and to reduce a working cost by replacing only a damaged second terminal member with a new one. Further, it is possible to easily manufacture, on demand, the interposer including the joint terminal capable of generating a required contact pressure to the counterpart conductor portion, by attaching the second terminal member selected from the several types of second terminal members having various spring constants to the first terminal member fixed to the substrate.

BRIEF DESCRIPTION OF THE DRAWINGS

The above and other objects, features and advantages of the present invention will become more apparent from the following description of the embodiments in connection with the accompanying drawings, wherein.

DESCRIPTION OF THE EMBODIMENT

Figure 1:
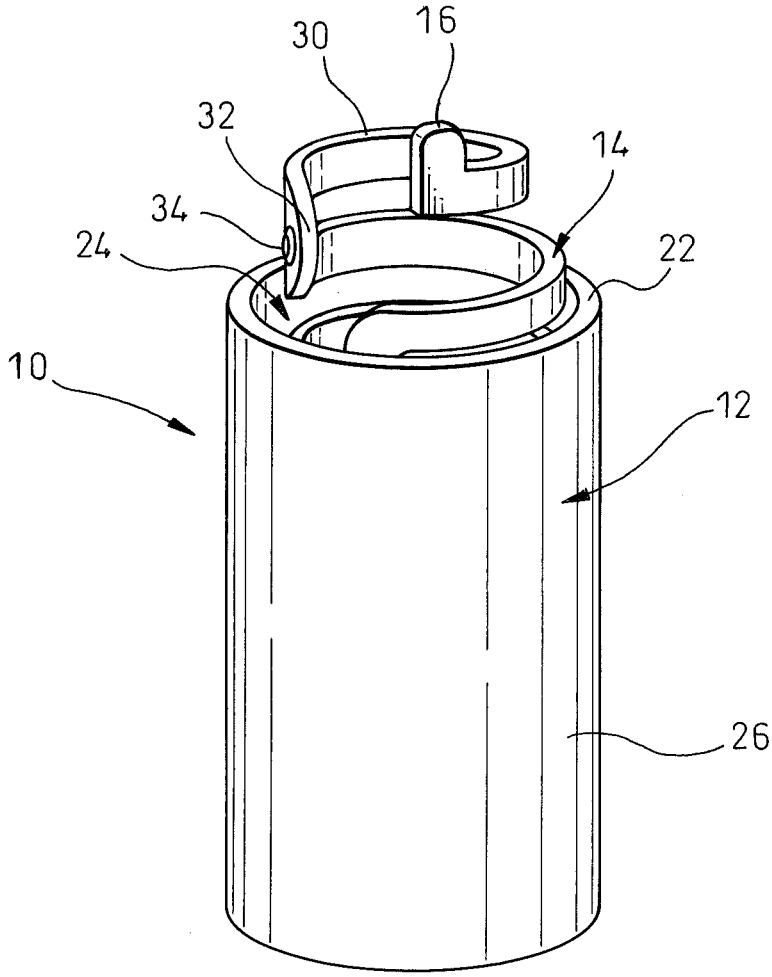
FIG. 1 is a perspective view depicting a joint terminal according to an embodiment of the present invention.

The embodiments of the present invention are described below, in detail, with reference to the accompanying drawings. In the drawings, the same or similar components are denoted by common reference numerals.

Figure 2:
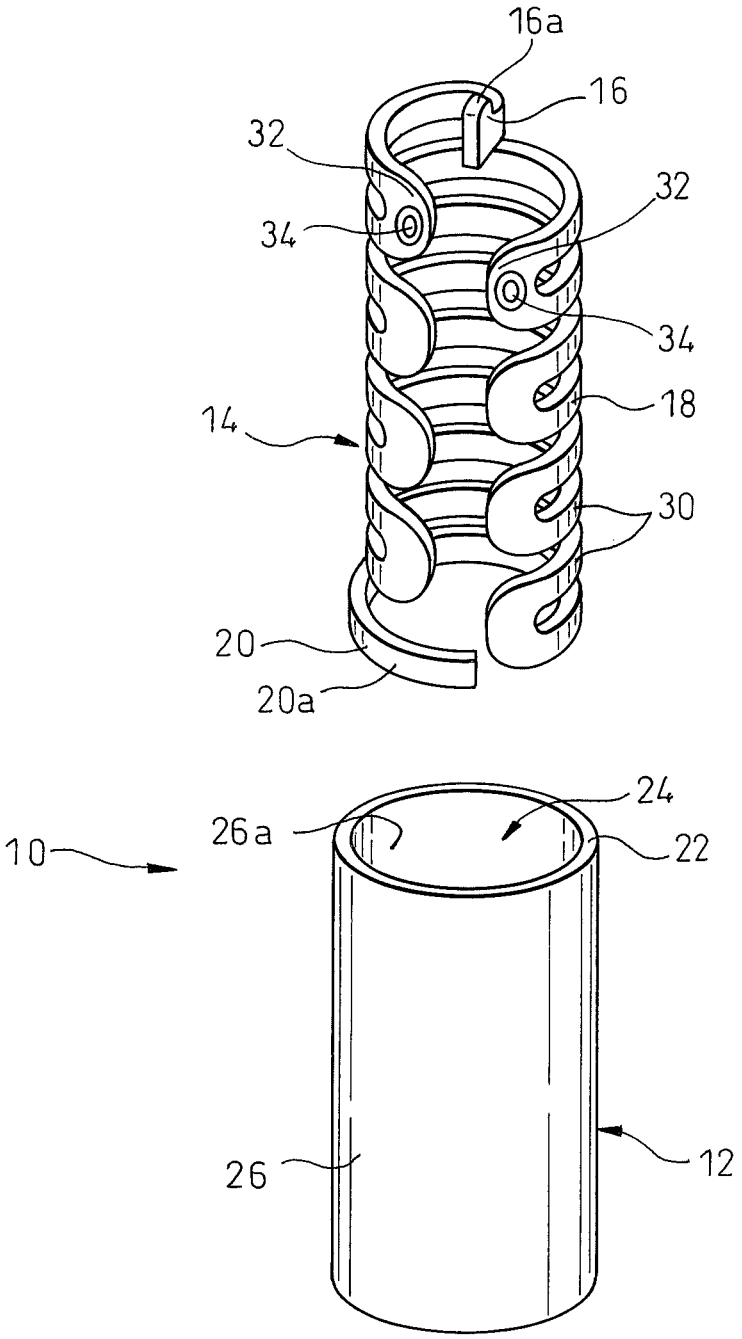
FIG. 2 is an exploded perspective view depicting the joint terminal of FIG. 1.
Figure 3:
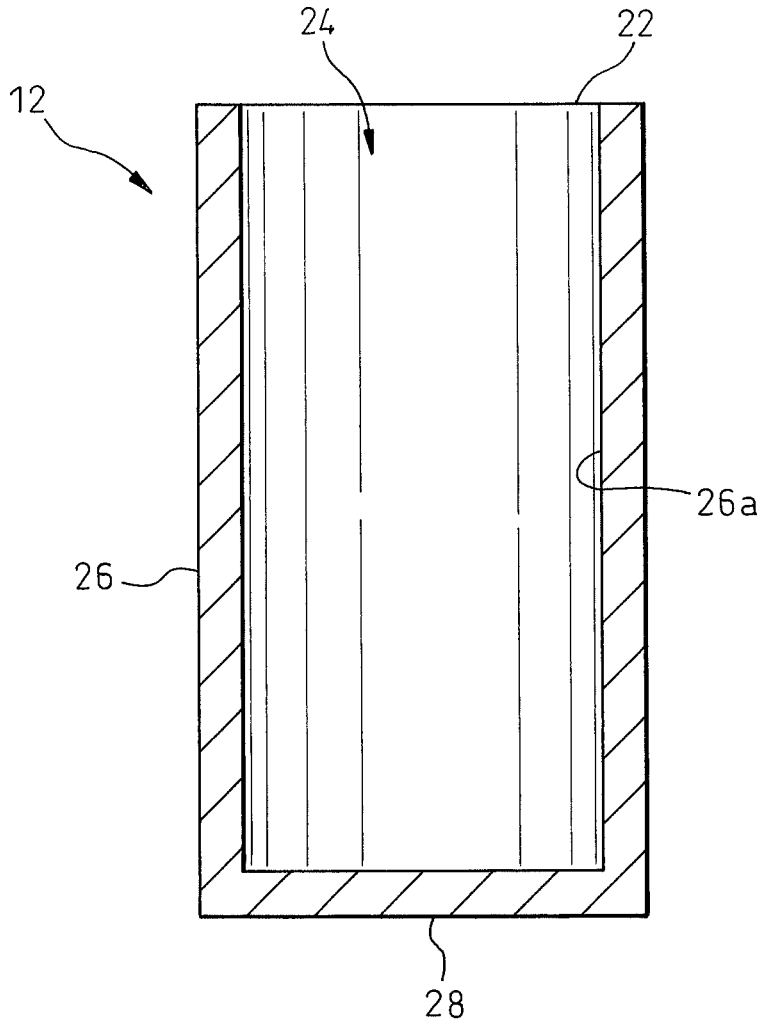
FIG. 3 is a sectional view depicting a first terminal member provided in the joint terminal of FIG. 1.
Figure 4:
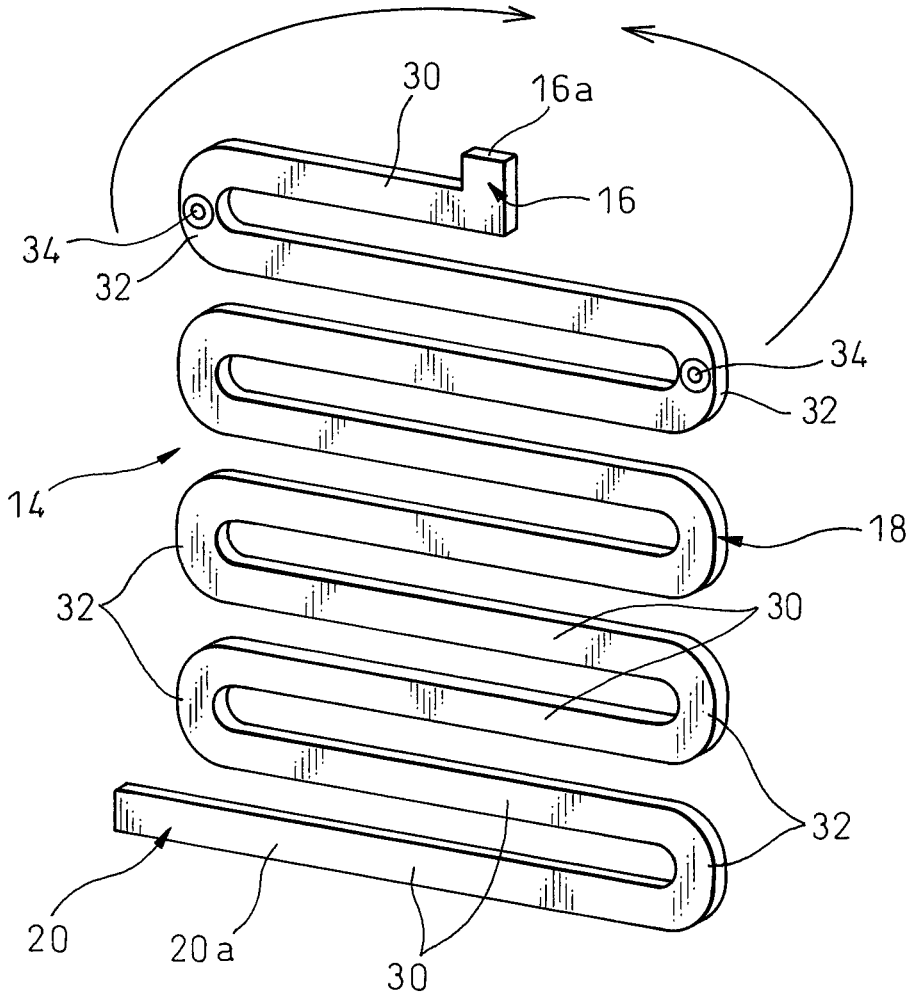
FIG. 4 is a perspective view depicting a second terminal member provided in the joint terminal of FIG. 1, in a form prior to being bent into a final shape.

Referring to the drawings, FIGS. 1 and 2 depict the external appearance of a joint terminal 10 according to one embodiment of the present invention, FIG. 3 depicts one component of the joint terminal 10 by a vertical section, and FIG. 4 depicts another component of the joint terminal 10 in a form prior to a final shape. The joint terminal 10 can be incorporated with a substrate (not depicted), so as to be used as a joint terminal of an interposer adapted to be interposed between two electronic circuit components (not depicted), such as a circuit board (a PWB, a PCB, etc.) and an IC package, and adapted to fulfill a function such as converting the arrangement or number of connection terminals of the electronic circuit components, absorbing the difference in thermal deformation of the electronic circuit components, etc.

The joint terminal 10 is provided with a first terminal member 12 adapted to be fixed to the substrate, and a second terminal member 14 detachably attached to the first terminal member 12 and electrically conductible to the first terminal member 12. The second terminal member 14 includes a contact part 16 capable of contacting with and separating from a conductor portion of a counterpart (not depicted) of the interposer, a spring part 18 adapted to generate a contact pressure for pushing the contact part 16 against the conductor portion, and an attachment part 20 abutting on and detachably attached by a frictional force to the first terminal member 12. The contact part 16, the spring part 18 and the attachment part 20 are formed integrally with each other as a unitary member.

The first terminal member 12 is formed into a predetermined shape from a metallic material with a good electrical conductivity, and has rigidity sufficient to at least maintain its own initial shape against the contact pressure generated between the joint terminal 10 and the counterpart conductor portion. The second terminal member 14 is formed into a predetermined shape from a metallic material with a good electric conductivity, and has spring properties adapted to be elastically deformed so as to generate the required contact pressure when the joint terminal 10 is connected to the counterpart conductor portion. Except for these features, the materials, shapes, dimensions, etc., of the first and second terminal members 12 and 14 are not particularly limited.

The joint terminal 10 configured as described above has a two-piece structure wherein the first terminal member 12 and the second terminal member 14 are able to be attached to and detached from each other. Therefore, when the joint terminal 10 is deformed or damaged in, especially, the contact part 16 or the spring part 18, it is possible to replace only the second terminal member 14 with a new one while the first terminal member 12 remains to be fixed to the substrate. As a result, in the interposer including a plurality of joint terminals 10 fixed to the substrate, a repairing work of the joint terminals 10 can be facilitated, and a working cost can be reduced by replacing only the damaged second terminal member 14 with a new one. In this connection, it is predicted that the deformation or damage in the joint terminal 10 may occur relatively easily at the second terminal members 14 having the spring properties for ensuring the contact pressure and having possibilities of repeatedly contacting with and separating from other conductors, in comparison with the first terminal member 12 as a fixed member having rigidity.

The joint terminal 10 is configured by combining the first terminal member 12 having rigidity and the second terminal member 14 having spring properties, so that it is possible to select a second terminal member 14 having a desired spring constant, from among several different types of previously prepared second terminal members 14 having various spring constants, and attach the selected second terminal member 14 to the first terminal member 12 for use. Therefore, it is possible to easily manufacture, on demand, the interposer including the joint terminal 10 capable of generating a required contact pressure to a counterpart conductor portion, only by attaching the second terminal member 14 selected from the several types of second terminal members 14 to the first terminal member 12 fixed to the substrate.

The second terminal member 14 is the integrally-formed unitary member including the contact part 16, the spring part 18 and the attachment part 20, so that the second terminal member 14 is easy to be handled and able to be simply produced. The attachment part 20 is designed to abut on and detachably attached by a frictional force to the first terminal member 12, so that attachment and detachment work of the second terminal member 14 with respect to the first terminal member 12 is facilitated.

In the illustrated configuration, the first terminal member 12 is provided with a tubular wall part 26 having an open end 22 and defining a hollow region 24 inside the wall part. The second terminal member 14 is housed in the hollow region 24 of the wall part 26 with the contact part 16 projecting outward through the open end 22 of the wall part 26, and the attachment part 20 is attached to the inner surface 26*a* of the wall part 26. In this state, the contact part 16 and the spring part 18 of the second terminal member 14 are suitably movable with respect the wall part 26 of the first terminal member 12. According, to the above configuration, only by inserting the second terminal member 14 into the hollow region 24 of the tubular wall part 26, it is possible to accurately attach the second terminal member 14 to the first terminal member 12 in a predetermined relative positional relationship. When the joint terminal 10 is connected to the counterpart conductor portion, the contact part 16 and the spring part 18 can move with respect to the wall part 26 while the spring part 18 is elastically deformed, so that the required contact pressure can be undisturbedly ensured. Although the wall part 26 of the first terminal member 12 has a cylindrical shape in the illustrated configuration, the shape of the wall part 26 is not limited thereto but may be one of various hollow tubular shapes.

The wall part 26 of the first terminal member 12 also has a closed end (i.e., a bottom part) 28 opposite to the open end 22, which can be fixed to the substrate (not depicted). The wall part 26 and the bottom part 28 may be formed integrally with each other as a unitary member from, e.g., a sheet metal through, e.g., a drawing process. Alternatively, the wall part 26 and the bottom part 28 may be previously formed separately from each other and joined together through a later process. According to the above configuration, for example, when a joint terminal 10 is fixed to the substrate by soldering, solder may be placed between the bottom part 28 of the first terminal member 12 and a patterned conductor (not depicted) on the substrate, so that it is possible to prevent molten solder from entering the interior of the first terminal member 12 and also prevent solder from depositing on the second terminal member 14. As a result, it is possible to avoid any trouble due to deposited solder before it occurs, such as difficulty in detaching the second terminal member 14 from the first terminal member 12 or deterioration of the spring properties of the second terminal member 14.

The attachment part 20 of the second terminal member 14 may be designed to be pushed against the first terminal member 12 by an elastic restoring force generated in the second terminal member 14, and thereby attached to the first terminal member 12. According to this configuration, it is possible to fixedly attach the second terminal member 14 to the first terminal member 12 in a predetermined relative positional relationship by the frictional force increased due to the elastic restoring force of the second terminal member 14. Also, by forcibly and elastically bending the attachment part 20 at the attached position thereof and pulling it away from the first terminal member 12, it is possible to easily detach the second terminal member 14 from the first terminal member 12. Further, the attachment part 20 is pushed against the first terminal member 12 under a predetermined pressure generated due to the elastic restoring force of the second terminal member 14, so that it is possible to improve the reliability of an electrical conduction (i.e., an electrical connection) between the first terminal member 12 and the second terminal member 14.

In the illustrated configuration, the spring part 18 of the second terminal member 14 includes a plurality of beams 30 arranged in parallel to each other and a plurality of connections 32 each connecting a pair of adjoining beams 30 with each other at the corresponding-side ends of the beams 30. As depicted in FIG. 4, the connections 32 are alternately arranged at opposite ends of the beams 30 to form the spring part 18 into a continuous meandering shape. In the second terminal member 14 having the above configuration, it is possible to easily form the final shape depicted in FIG. 2 by, for example, punching a sheet metal into the meandering shape depicted in FIG. 4 to obtain a blank and bending the blank in a direction such that the connections 32 at one ends of the beams 30 shift towards the connections 32 at the other ends of the beams 30 so as to exhibit as a whole a cylindrical contour. In the case where the second terminal member 14 is produced by the above process, the cost of manufacturing the joint terminal 10 can be reduced.

The second terminal member 14 can exhibit a spring force in the final shape of FIG. 2 by the elastic deformation of the spring part 18 as a whole in a direction along the center axis of the cylindrical contour. The spring constant of the spring part 18 may be suitably determined by the selection of the material of the second terminal member 14 and/or the number, shape, dimensions, etc. of the beams 30. The number, shape or dimensions of the beams 30 can be suitably selected in a punching process of the sheet metal. By adjusting the spring constant of the spring part 18, it is possible to optimize the contact pressure between the second terminal member 14 and the counterpart conductor portion so as to maintain a good conducting state therebetween.

In the illustrated configuration, the contact part 16 of the second terminal member 14 is formed on one beam 30 positioned at a first end (an upper end, in the drawing) of the meandering shape of the spring part 18, and the attachment part 20 is formed on another beam 30 positioned at a second end (a bottom end, in the drawing) of the meandering shape of the spring part 18 opposite to the first-end beam 30. More specifically, the contact part 16 is formed as an extension projecting slightly from the first-end beam 30 laterally along a major surface of the sheet metal of the second terminal member 14, and a sheared surface 16*a* of the sheet metal is used as a contact surface adapted to contact with the counterpart conductor portion. Further, the attachment part 20 is formed by a predetermined length of the second-end beam 30, and a major surface 20*a* of the sheet metal of the second terminal member 14 is used as an abutting surface adapted to abut on the first terminal member 12.

According to the above configuration, it is possible to ensure a maximum distance between the contact part 16 and the attachment part 20 and thus make the spring part 18 exhibit in its entirety the spring force (and the resultant contact pressure). Also, in the second terminal member 14 having the cylindrical contour depicted in FIG. 2, it is possible to locate the contact part 16 on the center axis of the cylindrical contour, and therefore, it is possible to facilitate an alignment between the contact part 16 and the counterpart conductor portion. Further, in the configuration depicted in FIG. 2, it is possible to form the second-end beam 30 so as to project radially outward from the remaining beams 30 by bending the second terminal member 14 in such a manner that the curvature of the second-end beam 30 of the spring part 18 becomes smaller than the curvature of the remaining beams 30, and therefore, it is possible to make the attachment part 20 abut on the inner surface 26*a* of the wall part 26 of the first terminal member 12 while elastically deflecting the second-end beam 30 radially inward. As a result, it is possible to readily accomplish a configuration wherein the attachment part 20 formed on the second-end beam 30 is pushed against the first terminal member 12 by the elastic restoring force generated in the second terminal member 14 and thereby attached to the first terminal member 12.

The second terminal member 14 may further include a conduction part 34 slidably contacting with and electrically conducted to the first terminal member 12, the conduction part 34 being disposed at a location away from the contact part 16 and the attachment part 20. The conduction part 34 is configured so as to be able to slide on the first terminal member 12 while maintaining a stable contact state therebetween during a time when the joint terminal 10 is connected to the counterpart conductor portion and thereby the spring part 18 is elastically deformed. According to the above configuration, it is possible to ensure the electrical conduction between the first terminal member 12 and the second terminal member 14 at least at two locations of the attachment part 20 and the conduction part 34, and therefore, it is possible to improve the reliability of the electrical conduction between the first terminal member 12 and the second terminal member 14. In this connection, although the illustrated second terminal member 14 including the meandering spring part 18 between the contact part 16 and the attachment part 20 tends to have a large resistance value with respect to an electric current flowing through the spring part 18, the current flowing through the spring part 18 is allowed to branch off in the middle of the spring part 18 through the conduction part 34 toward the first terminal member 12 by forming the conduction part 34 at a desired position on the spring part 18. Further, when the first terminal member 12 is formed into a simple shape having, e.g., the illustrated tubular wall part 26, it is possible to reduce the resistance value of the joint terminal 10 as a whole. From the viewpoint of reduction in the resistance value by a branch current, it is advantageous to provide the conduction part 34 at a position close to the contact part 16 as much as possible.

The conduction part 34 of the second terminal member 14 may be configured to be pushed against the first terminal member 12 by the elastic restoring force generated in the second terminal member 14 in itself, and thereby contacting with the first terminal member 12. According to this configuration, the conduction part 34 is allowed to contact with the first terminal member 12 under a predetermined pressure due to the elastic restoring force of the second terminal member 14, so that it is possible to further improve the reliability of the electrical conduction (i.e., the electrical connection) between the first terminal member 12 and the second terminal member 14. In this connection, it is preferable that the elastic restoring force of the second terminal member 14 for pushing the conduction part 34 against the first terminal member 12 is determined to be smaller than the aforementioned elastic restoring force of the second terminal member 14 for pushing the attachment part 20 against the first terminal member 12, provided that the frictional force between the conduction part 34 and the first terminal member 12 does not obstruct the elastic deformation of the spring part 18 for ensuring the required contact pressure at the contact part 16.

In the illustrated configuration, the conduction part 34 of the second terminal member 14 is formed on at least one of the connections 32 of the spring part 18 having the meandering shape (two connections 32, in the drawing). The conduction part 34 may be formed as a protrusion projecting from the major surface of the sheet metal of the second terminal member 14 (FIG. 1) by, for example, half-blanking a predetermined point in the desired connection 32 during a process for punching the sheet metal to obtain the blank having the meandering shape as depicted in FIG. 4. In the second terminal member 14 having the cylindrical contour depicted in FIG. 2, it is possible to suitably select the amount of projection of the conduction part 34 from the major surface of the connection 32 on which the conduction part 34 is formed, and therefore, it is possible to make the conduction part 34 abut on the inner surface 26*a* of the wall part 26 of the first terminal member 12 while elastically deflecting a pair of beams 30 adjacent to the said connection 32 radially inward. As a result, it is possible to readily accomplish a configuration wherein the conduction part 34 formed on the connection 32 is pushed against the first terminal member 12 by the elastic restoring force generated in the second terminal member 14 and thereby contacting with the first terminal member 12. In this connection, it is possible to form the conduction part 34 so as to project radially outward further from the remaining beams 30 by bending the second terminal member 14 in such a manner that the curvature of the pair of beams 30 adjacent to the connection 32 on which the conduction part 34 is formed becomes smaller than the curvature of remaining beams 30.

In the illustrated configuration, conduction parts 34 are formed respectively on the connection 32 adjacent to the first-end beam 30, on which the contact part 16 is formed, and the other connection 32 adjacent to the other beam 30 subsequent to the first-end beam 30. As depicted in FIG. 1, in the state where the second terminal member 14 housed in the first terminal member 12 is not deflected or contracted in the axial direction, the conduction part 34 located adjacent to the first-end beam 30 is disposed at a position projecting outward from the open end 22 of the first terminal member 12. In the state where the joint terminal 10 is connected to the conductor portion of the counterpart of the interposer, the second terminal member 14 is deflected or contracted in the axial direction, and the conduction part 34 adjacent to the first-end beam 30 is pushed into the hollow region 24 of the first terminal member 12 and allowed to contact with the wall part 26.

Figure 5:
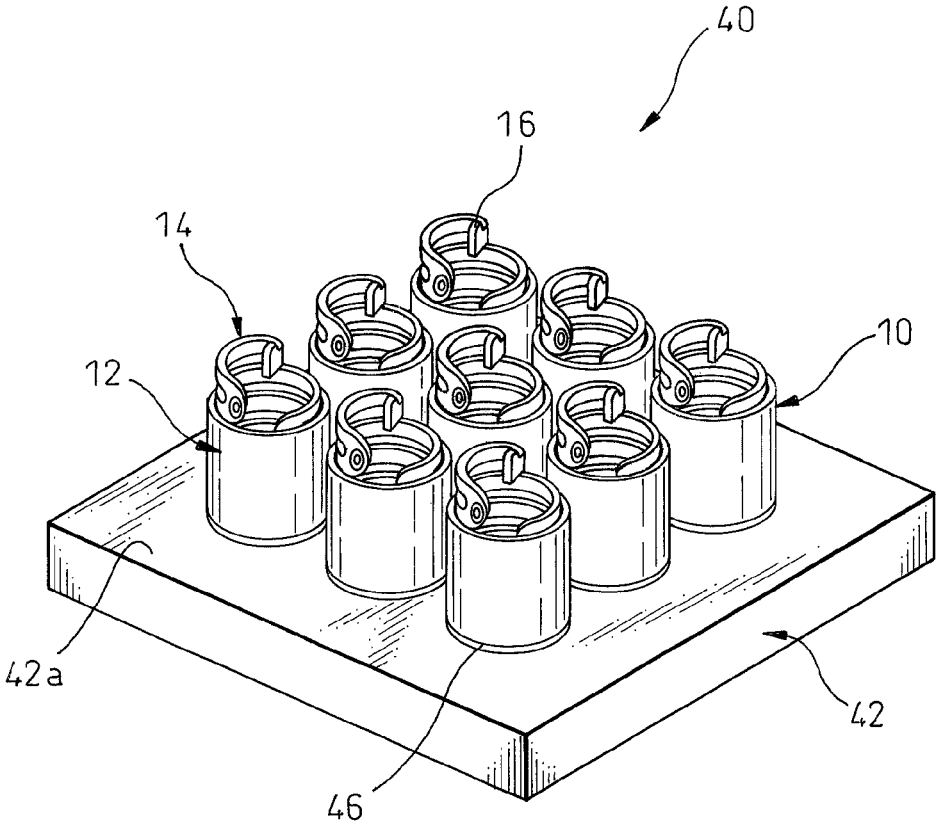
FIG. 5 is a perspective view of an interposer according to an embodiment of the present invention.
Figure 6A:
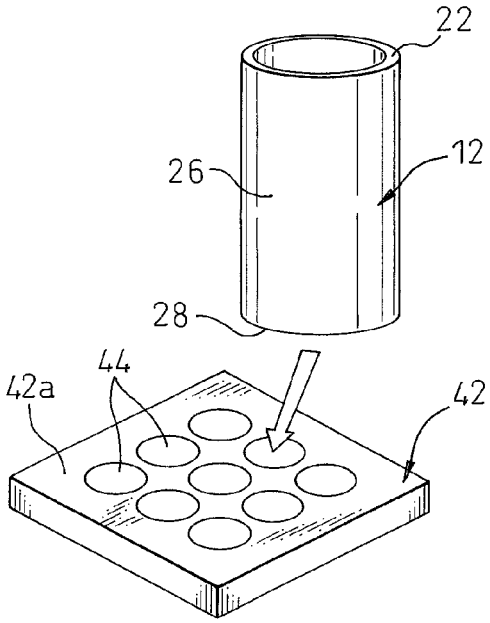
FIG. 6A depicts one step in an assembling process of the interposer of FIG. 5, before fixing a first terminal member of a joint terminal to a substrate.
Figure 6B:
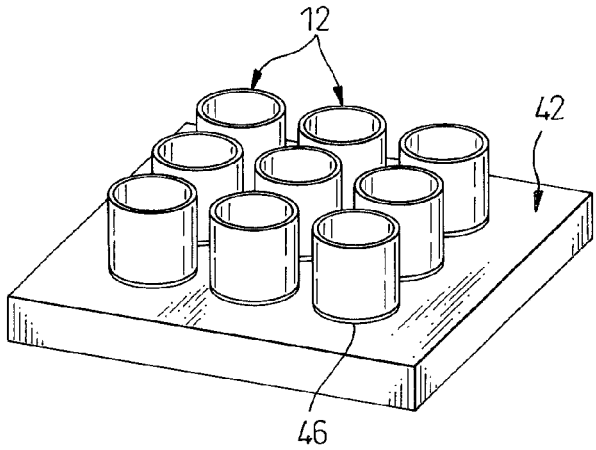
FIG. 6B depicts another step in the assembling process, after fixing the first terminal members of a plurality of joint terminals to the substrate.
Figure 6C:
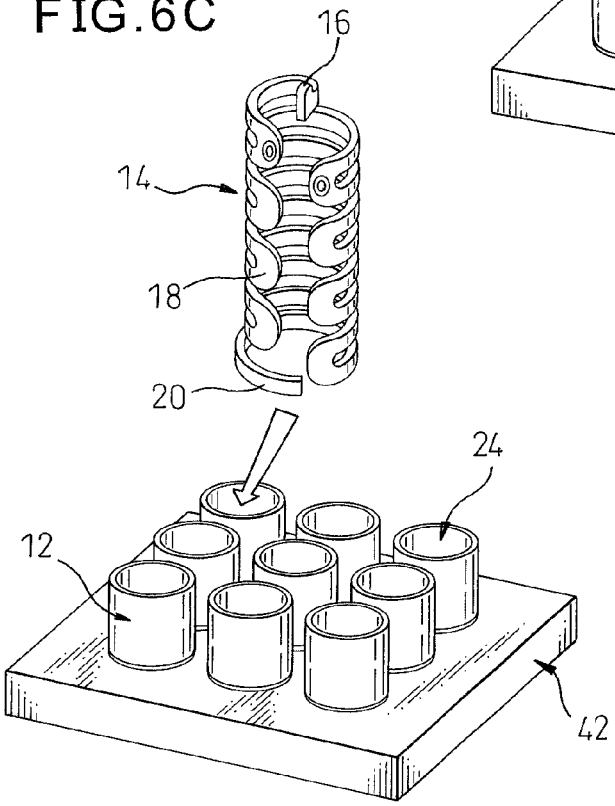
FIG. 6C depicts a further step in the assembling process, before respectively attaching second terminal members to the first terminal members of the joint terminals.
Figure 7:
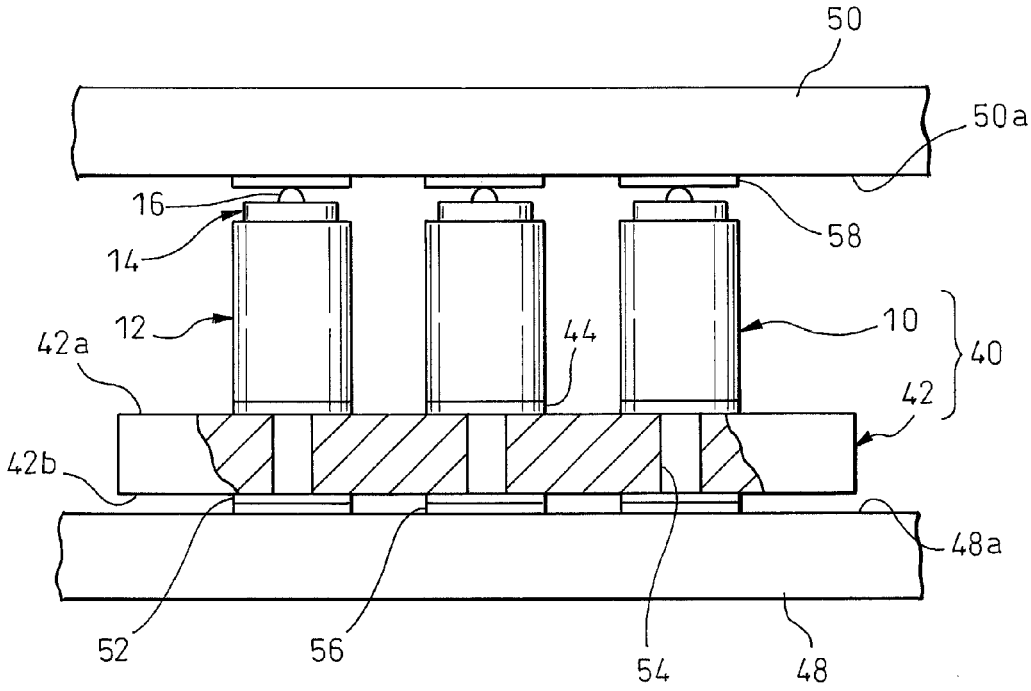
FIG. 7 is a partly sectional front view illustrating one exemplary use of the interposer of FIG. 5.

FIG. 5 depicts the external appearance of an interposer 40 according to one embodiment of the present invention, FIGS. 6A-6C depict several steps in the assembling process of the interposer 40, and FIG. 7 depicts one exemplary use of the interposer 40. The interposer 40 includes the joint terminal 10 depicted in FIGS. 1-4 and a substrate 42 to which the first terminal member 12 of the joint terminal 10 is fixed. In the illustrated configuration, a plurality of (nine, in the drawing) joint terminals 10 each configured by attaching the second terminal member 14 to the first terminal member 12 with the contact part 16 projecting out of the first terminal member 12 are disposed in a predetermined array on the surface 42*a* of the substrate 42 (FIG. 5). However, the number and/or arrangement of the joint terminals 10 are not particularly limited.

The substrate 42 is a circuit board provided with a patterned conductor electrically connected to the first terminal member 12 of the joint terminal 10. In the illustrated configuration, a plurality of pads 44 are formed on the surface 42*a* of the substrate 42 as patterned conductors, and the first terminal members 12 are respectively fixed to the pads 44 by, for example, solders 46 (FIGS. 6A and 6B). In this connection, when each first terminal member 12 is formed as a tubular member with the aforementioned closed end (or bottom part) 28, it is possible to place the solder 46 between the bottom part 28 of the first terminal member 12 and the corresponding pad 44 of the substrate 42 and thereby fix the first terminal member 12 to the substrate 42 while preventing molten solder from entering the interior of the first terminal member 12 and also prevent solder from depositing on the second terminal member 14.

The required number of the first terminal members 12 is fixed to the substrate 42, and thereafter the second terminal members 14 are respectively attached to the corresponding first terminal members 12. In the illustrated configuration, the second terminal member 14 having the cylindrical contour is inserted into the hollow region 24 of the wall part 26 of the first terminal member 12 with the attachment part 20, as a leading end, elastically deflected radially inward (FIG. 6C). At a time when the attachment part 20 reaches a position adjoining the bottom part 28 of the first terminal member 12, the attachment of the second terminal member 14 is completed (FIG. 5).

The interposer 40 may be interposed between two electronic circuit components, such as a circuit board (a PWB, a PCB, etc.) and an IC package, and may fulfill a function such as converting the arrangement or number of connection terminals of the electronic circuit components, absorbing the difference in thermal deformation of the electronic circuit components, etc. In the exemplary use depicted in FIG. 7, the interposer 40 is interposed between a first circuit board 48 and a second circuit board 50. In this configuration, the substrate 42 of the interposer 40 is further provided with a plurality of pads 52 patterned on the back surface 42*b* opposite to the front surface 42*a* and a plurality of via holes (i.e., plated through holes) 54 electrically connecting the pads 44 on the front surface 42*a* respectively to the pads 52 on the back surface 42*b* formed at corresponding positions.

In the illustrated interposer 40, the pads 52 on the back surface 42*b* of the substrate 42 are fixed and connected respectively to the conductor portions (or connection terminals) 56 patterned on the front surface 48*a* of the first circuit board 48 by, for example, solder, and the contact parts 16 of the second terminal members 14 of the joint terminals 10 are connected respectively to the conductor portions (or connection terminals) 58 patterned on the front surface 50*a* of the second circuit board 50 under the predetermined contact pressure generated due to the spring force of the spring parts 18 (FIG. 6C) of the second terminal members 14. In this state, the interposer 40 is interposed between the first and second circuit boards 48, 50 and electrically connects the circuit boards 48, 50 with each other.

In the above exemplary use, the interposer 40 can establish the electrical connection between the first and second circuit boards 48, 50, even when the first and second circuit boards 48, 50 have mutually different arrangements or numbers of conductor portions 56, 58, by suitably designing the patterned conductors (including the pads 52 and the via holes 54) of the substrate 42 so as to be able to convert the arrangement or number of the conductor portions 56 to the arrangement or number of the conductor portions 58. Alternatively, in an application where the conversion of the arrangements or numbers of connection terminals of the electronic circuit components is not required, the substrate 42 may be formed as a simple carrier board with no circuitry, wherein the first terminal members 12 of the joint terminals 10 are inserted into and fixed to through holes formed in the substrate 42, and the bottom parts 28 of the first terminal members 12 positioned at the side of the back surface 42*b* of the substrate 42 and the contact parts 16 of the second terminal members 14 positioned at the side of the front surface 42*a* of the substrate 42 are respectively connected to the conductor portions 56, 58 of the first and second circuit boards 48, 50. In the case of the above configuration, the substrate 42 of the interposer 40 may be omitted and only the joint terminals 10 may be used as an interposer.

According to the interposer 40 having the above configuration, due to the provision of the joint terminals 10 each fulfilling the aforementioned various advantageous effects, it is possible to facilitate a work for repairing the joint terminals 10 and to reduce a working cost by replacing only a damaged second terminal member 14 with a new one. Further, it is possible to easily manufacture, on demand, the interposer 40 including the joint terminal 10 capable of generating a required contact pressure to the counterpart conductor portion 58, by attaching the second terminal member 14 selected from the several types of second terminal members 14 having various spring constants to the first terminal member 12 fixed to the substrate 42.

While the invention has been described with reference to specific embodiments, it will be understood by those skilled in the art that various changes and modifications may be made thereto without departing from the scope of the following claims.

The invention claimed is:

1. A joint terminal usable in an interposer, comprising:

a first terminal member; and a second terminal member detachably attached to said first terminal member and electrically conductible to said first terminal member, said second terminal member including:

a contact part capable of contacting with and separating from a conductor portion of a counterpart of the interposer;

a spring part adapted to generate a contact pressure for pushing said contact part against said conductor portion;

an attachment part abutting on and detachably attached by a frictional force to said first terminal member; and a conduction part slidably contacting with and electrically conducted to said first terminal member, said conduction part disposed at a location away from said contact part and said attachment part, said contact part, said spring part and said attachment part being formed integrally with each other as a unitary member.

2. The joint terminal of claim 1, wherein said first terminal member is provided with a tubular wall part having an open end; and wherein said second terminal member is housed in said wall part with said contact part projecting outward through said open end of said wall part, said attachment part being attached to said wall part, and said contact part and said spring part being movable with respect to said wall part.

3. The joint terminal of claim 2, wherein said wall part of said first terminal member has a closed end opposite to said open end.

4. The joint terminal of claim 1, wherein said attachment part of second terminal member is pushed against said first terminal member by an elastic restoring force generated in said second terminal member, and thereby attached to said first terminal member.

5. The joint terminal of claim 1, wherein said spring part of said second terminal member includes a plurality of beams arranged in parallel to each other and a plurality of connections each connecting a pair of adjoining beams to each other at ends of the beams, said connections being alternately arranged at opposite ends of said beams to form said spring part into a continuous meandering shape.

6. The joint terminal of claim 5, wherein said contact part is formed on one beam positioned at a first end of said meandering shape of said spring part, and said attachment part is formed on another beam positioned at a second end of said meandering shape of the spring part opposite to said first end.

7. An interposer configured to be interposed between a first circuit board and a second circuit board and electrically connect the first and second circuit boards with each other, the interposer comprising:

a substrate provided with a first pad on a first surface of the substrate and a second pad on a second surface of the substrate, the first pad electrically connected to the second pad and the second pad configured to be electrically connected to the first circuit board;

a first terminal member having a closed end and an open end, the closed end electrically connected to the first pad; and a second terminal member, detachably attached to said first terminal member through said open end and electrically conductible to said first terminal member, including:

a contact part configured to contact a conductor of the second circuit board;

a spring part configured to generate a pressure for pushing said contact part against the conductor; and an attachment part detachably attached to said first terminal member and abutting on an inner surface of said first terminal member, said contact part, said spring part and said attachment part being formed integrally with each other as a unitary member.

8. The joint terminal of claim 1, wherein said conduction part of said second terminal member is pushed against said first terminal member by an elastic restoring force generated in said second terminal member, and thereby contacting with said first terminal member.

9. The joint terminal of claim 1, wherein said spring part of said second terminal member includes a plurality of beams arranged in parallel to each other and a plurality of connections each connecting a pair of adjoining beams to each other at ends of the beams, said connections being alternately arranged at opposite ends of said beams to form said spring part into a continuous meandering shape.

10. The joint terminal of claim 9, wherein said contact part is formed on one beam positioned at a first end of said meandering shape of said spring part, said attachment part is formed on another beam positioned at a second end of said meandering shape of the spring part opposite to said first end, and said conduction part is formed on at least one of said connections.

11. The interposer of claim 7, wherein said substrate is provided with a patterned conductor comprising the first pad.

* * * * *